US006315399B1

(12) United States Patent
Silverbrook

(10) Patent No.: US 6,315,399 B1
(45) Date of Patent: Nov. 13, 2001

(54) MICRO-MECHANICAL DEVICE COMPRISING A LIQUID CHAMBER

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 09/575,142

(22) Filed: May 23, 2000

(30) Foreign Application Priority Data

Jun. 30, 1999 (AU) ..... PQ1310

(51) Int. Cl.[7] ..... B41J 2/05; B41J 2/04
(52) U.S. Cl. ..... 347/65; 347/54
(58) Field of Search ..... 347/68, 65, 63, 347/56, 54, 20; 60/528, 529

(56) References Cited

U.S. PATENT DOCUMENTS

| | | | | |
|---|---|---|---|---|
| 4,581,624 | * | 4/1986 | O'Connor | 251/129.06 |
| 4,770,740 | * | 9/1988 | Tsuzuki et al. | 347/54 |
| 5,058,856 | * | 10/1991 | Gordon et al. | 251/11 |
| 5,378,504 | | 1/1995 | Bayard et al. . | |
| 5,905,517 | | 5/1999 | Silverbrook . | |
| 5,943,075 | | 8/1999 | Lee et al. . | |
| 6,019,457 | | 2/2000 | Silverbrook . | |
| 6,044,646 | | 4/2000 | Silverbrook . | |
| 6,196,667 | * | 3/2001 | Hiroki et al. | 347/65 |

FOREIGN PATENT DOCUMENTS

| | | | | |
|---|---|---|---|---|
| 0 947 325 A1 | | 10/1999 | (EP) . | |
| 2-30543-A | * | 1/1990 | (JP) | B41J/2/45 |
| 4-1051-A | * | 1/1992 | (JP) | B41J/2/45 |
| WO 95/03179 | | 2/1995 | (WO) . | |

* cited by examiner

*Primary Examiner*—John Barlow
*Assistant Examiner*—Robert D. Loper, Jr.

(57) ABSTRACT

A micro-mechanical device having a liquid-containing chamber and a movable component extending into the chamber. Difficulties exist in sealing such a device against movement of liquid through an opening through which the movable component extends. This difficulty is resolved by shaping the movable member in such a way as to induce the formation and maintenance of the meniscus between a wall of the chamber and the movable component.

3 Claims, 2 Drawing Sheets

MICRO-MECHANICAL DEVICE COMPRISING A LIQUID CHAMBER

CO-PENDING APPLICATIONS

Various methods, systems and apparatus relating to the present invention are disclosed in the following co-pending applications filed by the applicant or assignee of the present invention simultaneously with the present application:

Ser. Nos. 09/575,197, 09/575,195, 09/575,159, 09/575,132, 09/575,123, 09/575,148, 09/575,130, 09/575,165, 09/575,153, 09/575,118, 09/575,131, 09/575,116, 09/575,144, 09/575,139, 09/575,186, 09/575,185, 09/575,191, 09/575,145, 09/575,192, 09/575,181, 09/575,193, 09/575,156, 09/575,183, 09/575,160, 09/575,150, 09/575,169, 09/575,184, 09/575,128, 09/575,180, 09/575,149, 09/575,179, 09/575,187, 09/575,155, 09/575,133, 09/575,143, 09/575,196, 09/575,198, 09/575,178, 09/575,164, 09/575,146, 09/575,174, 09/575,163, 09/575,168, 09/575,154, 09/575,129, 09/575,124, 09/575,188, 09/575,189, 09/575,162, 09/575,172, 09/575,170, 09/575,171, 09/575,161, 09/575,141, 09/575,125, 09/575,142, 09/575,140, 09/575,190, 09/575,138, 09/575,126, 09/575,127, 09/575,158, 09/575,117, 09/575,147, 09/575,152, 09/575,176, 09/575,151, 09/575,177, 09/575,175, 09/575,115, 09/575,114, 09/575,113, 09/575,112, 09/575,111, 09/575,108, 09/575,109, 09/575,182, 09/575,173, 09/575,194, 09/575,136, 09/575,119, 09/575,135, 09/575,157, 09/575,166, 09/575,134, 09/575,121, 09/575,137, 09/575,167, 09/575,120, 09/575,122.

The disclosures of these co-pending applications are incorporated herein by cross-reference.

FIELD OF THE INVENTION

The present invention relates broadly to micro-mechanical devices comprising a liquid chamber and providing a seal around a moveable component located in part within the liquid chamber. The present invention will be described herein with reference to micro-mechanical devices for ink jet printers. However, it will be appreciated that the present invention does have broad applications, including in micro-mechanical pumps.

BACKGROUND OF THE INVENTION

Commercially constructed micro-mechanical systems typically utilise standard semiconductor fabrication processes, and as those processes become more and more refined, the field of applications for micro-mechanical devices increases.

Recently, micro-electro-mechanical system (MEMS) devices have been proposed to be utilised in ink jet printing and other devices which involve fluids.

In such devices, one of the challenges is to provide adequate sealing for liquid nozzles or liquid channels within the MEMS device, particularly where the seal is to be provided between moving parts.

SUMMARY OF THE INVENTION

In accordance with a first aspect of the present invention there is provided a micro-mechanical device comprising a liquid chamber and a movable component located in part within the chamber and extending in a first direction through an opening in a wall of the chamber, the component being movable within the opening in a second direction orthogonal to the first direction. The component comprises a body portion which is located within the opening and which has a width substantially equal to the width of the opening, a stem portion which extends outside of the opening and away from the wall and having a smaller width than the body portion and a shoulder connecting the stem portion to the body portion. The shoulder is aligned with an outside edge of the opening, whereby a liquid in the chamber forms a meniscus between the outside edge and the shoulder and the meniscus is maintained during movement of the component in the second direction.

The shoulder may be in the form of a step connecting the stem portion to the body portion.

In one embodiment, the wall comprises a planar portion in an outer surface of the wall adjacent the opening.

A preferred form of the invention will now be described, by way of example only, with reference to the accompanying drawings.

DESCRIPTION OF THE PREFERRED EMBODIMENTS

Figure 1:
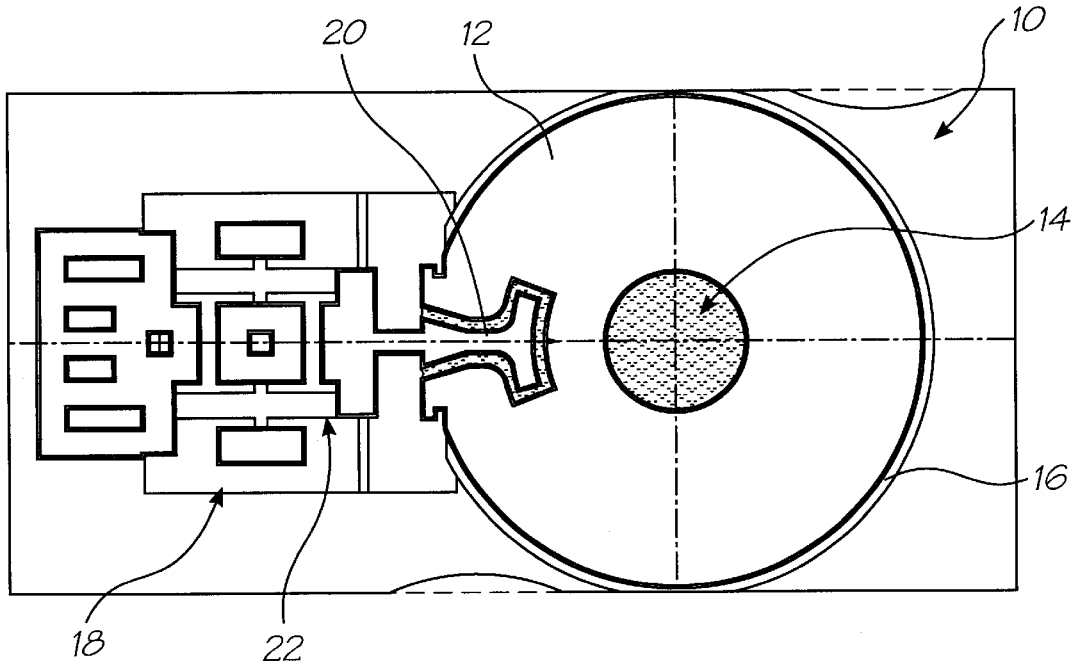
FIG. 1 shows a top plan view of an ink jet printing nozzle embodying the present invention.
Figure 2:
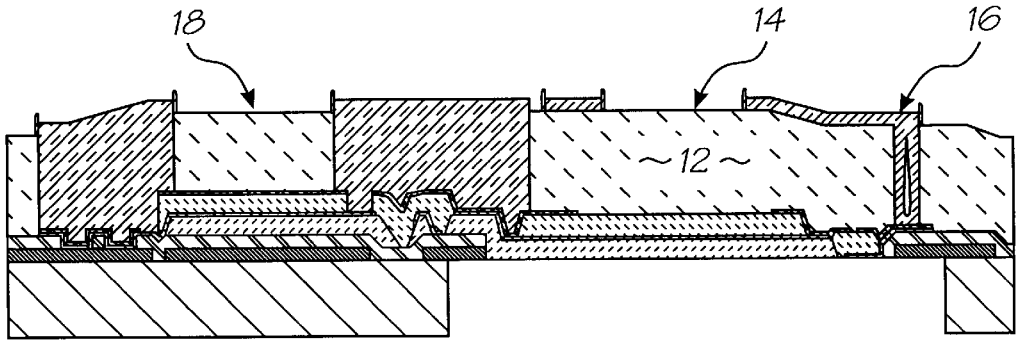
FIG. 2 shows a side plan view of the ink jet nozzle of FIG. 1.

Turning initially to FIG. 1, the ink jet nozzle 10 comprises a nozzle chamber 12 having an aperture 14 formed in a top wall 16 thereof.

A thermal actuator structure 18 comprises a first portion 20 located substantially within the nozzle chamber 12, and a second portion 22 located outside of the nozzle chamber 12.

Figure 3:
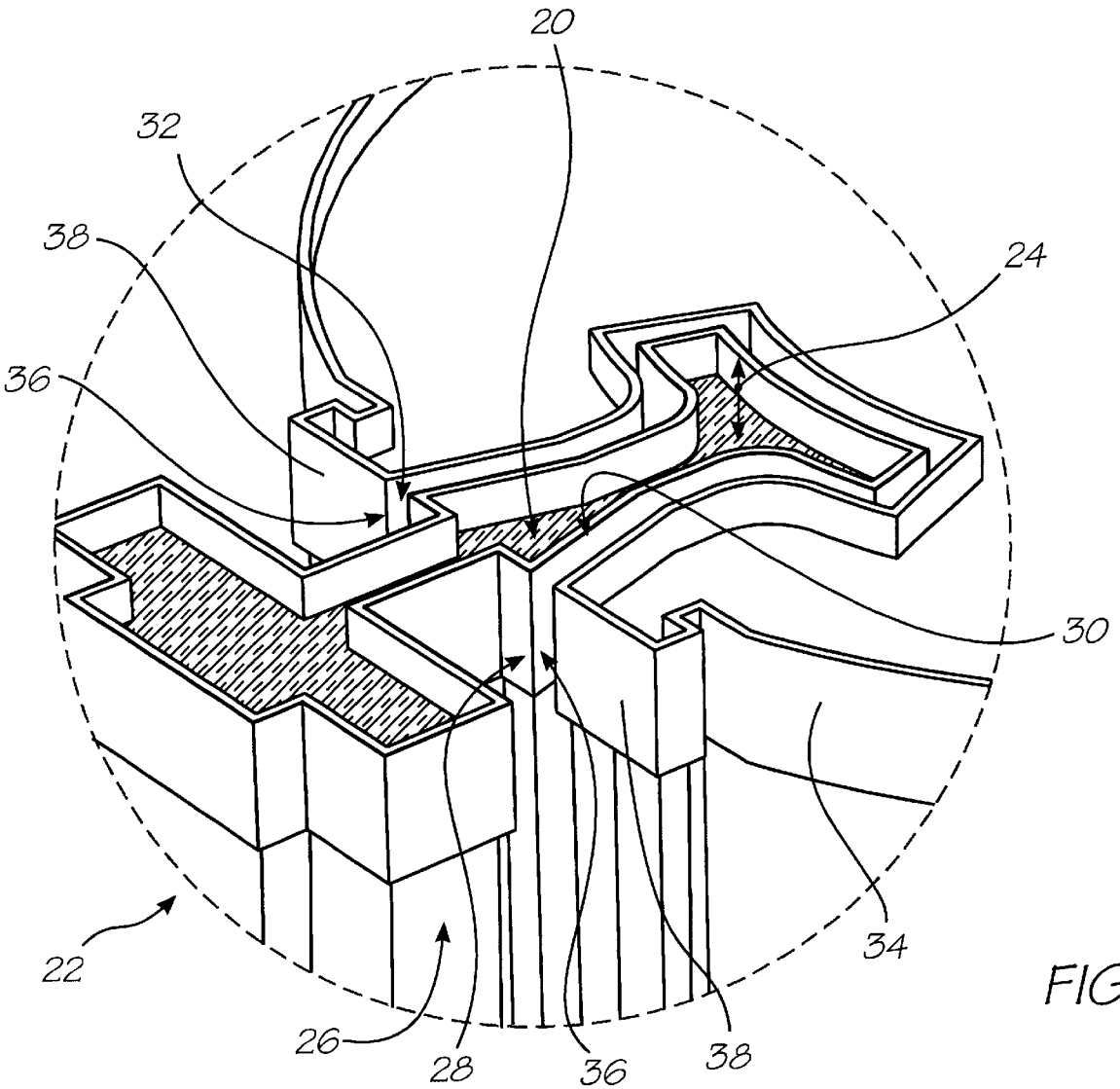
FIG. 3 shows a perspective view of a detail of the printing nozzle of FIGS. 1 and 2.

By way of movement of the actuator structure 18 substantially upwardly and downwardly with respect to the nozzle chamber 12, as illustrated by arrow 24 in FIG. 3, droplets of a liquid (not shown) contained within the nozzle chamber 12 can be ejected through the aperture 14.

Turning now to FIG. 3, the second portion 22 of the actuator structure 18 terminates in a stem portion 26. The stem portion is connected by a shoulder 28 to an end portion 30 of the first actuator portion 20. The end portion 30 is located within an opening 32 in a side wall 34 of the nozzle chamber 12. Again in FIG. 3, the arrow 24 indicates the movement of the first and second portion 20, 22 during operation.

It will be appreciated by a person skilled in the art that, provided adequate close spacing between the outer edges 36 of the opening 32 and the step 28 the liquid within the nozzle chamber 12 will form a meniscus between the step 28 and the outer edges 36 whereby a seal is formed preventing liquid from inside the chamber to leak through the space between the step 28 and the outer edges 36.

Furthermore, the meniscus will be maintained during movement of the first and second portions 20, 22 along a direction as indicated by arrow 24 during operation of the ink jet nozzle 10.

In the preferred embodiment, the side wall 34 comprises planar portions 38 adjacent the outer edges 36 of the opening 32. This arrangement can further decrease the likelihood of leaking or drawing of the liquid along the surface of the side wall 34, thus providing a greater freedom in the dimensioning of the spacing between the outer edges 36 of the opening 32 and the step 28.

The ink jet nozzle 10 of the preferred embodiment can be manufactured using known MEMS technology. For example, a plurality of ink jet nozzles 10 could be manufactured on a silicone wafer utilising the sequence of deposition and etching steps, further utilising sacrificial layers to e.g. free the actuator structure 18 and to form cavities such as the nozzle chamber 12.

It will be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

I claim:

1. A micro-mechanical device comprising:

a liquid chamber, and a movable component located in part within the chamber and extending in a first direction through an opening in a wall of the chamber, the movable component being movable within the opening in a second direction orthogonal to the first direction, and wherein the component comprises a body portion which is located within the opening, and which has a width substantially equal to the width of the opening, a stem portion which extends outside of the opening and away from the wall and which has a smaller width than that of the body portion, and a shoulder connecting the stem portion to the body portion, the shoulder being aligned with an outside edge of the opening whereby a liquid in the chamber forms a meniscus between the outside edge and the shoulder and the meniscus is maintained during movement of the component in the second direction.

2. A device as claimed in claim 1, wherein the shoulder is in the form of a step connecting the stem portion to the body portion.

3. A device as claimed in claim 1, wherein the wall comprises a planar portion at an outer surface of the wall adjacent the opening.

* * * * *